United States Patent [19]

Capp

[11] Patent Number: 4,813,887

[45] Date of Patent: Mar. 21, 1989

[54] ELECTRICAL CONNECTOR FOR MULTIPLE OUTER CONDUCTOR COAXIAL CABLE

[75] Inventor: Randolph E. Capp, Mechanicsburg, Pa.

[73] Assignee: AMP Incorporated, Harrisburg, Pa.

[21] Appl. No.: 148,207

[22] Filed: Jan. 22, 1988

Related U.S. Application Data

[63] Continuation of Ser. No. 904,514, Sep. 5, 1986, abandoned.

[51] Int. Cl.[4] ..... H01R 17/18

[52] U.S. Cl. ..... 439/580; 439/585; 439/745

[58] Field of Search ..... 439/98, 99, 578–585, 439/675, 877, 879, 743–748

[56] References Cited

U.S. PATENT DOCUMENTS

| | | | |
|---|---|---|---|
| 2,754,487 | 7/1956 | Carr et al. | 339/177 R |
| 3,103,548 | 9/1963 | Concelman | 339/177 R |
| 3,112,977 | 12/1963 | Long et al. | 339/217 S |
| 3,227,993 | 1/1966 | Bentley | 339/217 S |
| 3,390,374 | 6/1968 | Forney, Jr. et al. | 339/177 R |
| 3,475,545 | 10/1969 | Stark et al. | 339/276 R |
| 3,551,882 | 12/1970 | O'Keefe | 339/177 |
| 3,613,050 | 10/1971 | Andrews | 339/177 |
| 3,673,546 | 6/1972 | Green et al. | 339/89 C |
| 3,982,060 | 9/1976 | Avery et al. | 174/75 C |
| 4,400,050 | 8/1983 | Hayward | 339/177 R |
| 4,553,806 | 11/1985 | Forney, Jr. et al. | 339/94 C |
| 4,593,964 | 6/1986 | Forney, Jr. et al. | 339/94 C |
| 4,611,873 | 9/1986 | Punako et al. | 339/177 R |
| 4,688,878 | 8/1987 | Cohen et al. | 439/585 |

FOREIGN PATENT DOCUMENTS

| | | | |
|---|---|---|---|
| 1146532 | 3/1969 | United Kingdom | 339/217 S |

*Primary Examiner*—David Pirlot

*Attorney, Agent, or Firm*—Gerald K. Kita

[57] ABSTRACT

An electrical connector for an electrical cable with a plurality of conductors comprises a plurality of subassemblies that may be easily assembled and automatically aligned by plural captivation means provided on the subassemblies. Such a connector for a triaxial connector comprises a center contact subassembly to provide connection for the center conductor of the connector, an inner shell subassembly to provide connection for a first outer conductor of the cable, an outer shell subassembly to provide connection for a second outer conductor of the cable, and first and second captivation means for axially positioning the center contact subassembly, the inner shell subassembly and the outer shell subassembly with respect to one another during assembly of the connector to the cable. The connector further includes first and second ferrules for crimping the first and second outer conductors to the inner and outer shells, respectively, and ferrule positioning means on the second ferrule to hold the ferrule in axial position with respect to the outer shell during crimping.

2 Claims, 3 Drawing Sheets

47
34
37
38
36
52
53
33
41
43
45
31
42
32
23

92
93
91

63a
63
63b
62b
62
62a
22
65
61b
61
220
67
61a
68
69
64

62
63
22
64
61
81
82
21
13
17
14
18
92
16
91
10
23
34
31
19
12

87
82
86
81b
21
81
83
81a

ELECTRICAL CONNECTOR FOR MULTIPLE OUTER CONDUCTOR COAXIAL CABLE

This application is a continuation of application Ser. No. 904,514 filed Sept. 5, 1986, now abandoned.

BACKGROUND OF THE INVENTION

Coaxial and triaxial cables are used in a variety of electronic applications in which electromagnetic shielding is desired to provide noise-free transmission of the signal carried by the central conductor of the cable. Triaxial cables, for example, which contain a center conductor to carry an information-bearing signal and two outer conductors to provide shielding, are often used in high voltage applications wherein it is desired to reduce noise levels to a minimum.

Triaxial cables are often terminated by triaxial electrical connectors. Triaxial connectors typically contain a larger number of parts, and assembly of the connector onto a triaxial cable is a relatively difficult and time-consuming procedure. In particular, in known triaxial connectors, substantial care was required during the assembly process to ensure that the various connector components were properly positioned with respect to one another and, once positioned, were maintained in position during assembly onto the cable. The outer conductors of coaxial cables frequently comprise a braid of small conductors that lacks axial rigidity and may stretch or compress under load.

A particular difficulty in assembling known triaxial connectors was to avoid relative axial movement of the connector components, particularly the electrical contacts, during attachment of the connector to the cable. Axial misalignment of one or more of the electrical contacts in the connector frequently prevented the connector from properly mating with its complementary connector.

In many prior assembly techniques, it was also difficult to ensure that the ferrules used to crimp the outer conductors of the cable to the connector were in proper position during crimping to ensure proper electrical and mechanical attachment of the connector to the cable.

SUMMARY OF THE INVENTION

The present invention provides an electrical connector for terminating an electrical cable having a center conductor and a plurality of outer conductors.

This invention permits, for example, an electrical connector for triaxial cables, and other such cables comprised of coaxial conductors, to be manufactured as three subassemblies that may be easily assembled and automatically aligned in assembly by plural captivation means provided on the subassemblies. The plural captivation means comprise, in the preferred embodiment of the invention, resilient portions of the subassemblies that yield as the subassemblies are assembled on the cable and engage the adjoining subassemblies when the subassemblies are in proper alignment.

An electrical connector of the invention comprises center contact means including an electrically conductive center contact adapted to be electrically coupled to a center conductor of the cable; inner shell means including an electrically conductive inner shell adapted to be electrically coupled to a first outer conductor of the cable; outer shell means including an electrically conductive outer shell adapted to be electrically coupled to a second outer conductor of the cable; first captivation means for automatically positioning the center contact means and the inner shell means with respect to one another during assembly of the connector onto the cable; and second captivation means for automatically positioning the inner shell means and the outer shell means with respect to one another during assembly of the connector to the cable.

In a preferred embodiment of the invention, the connector comprises a triaxial connector for terminating a triaxial cable; and the outer shell, inner shell and center contact means comprise subassemblies which are manufactured as separate, fully assembled units, and which are connected to the cable as units to greatly simplify the assembly procedure. As the subassemblies are positioned relative to one another during assembly of the connector, their captivation means automatically secure the subassemblies to one another in correct axial alignment and maintain correct alignment during attachment of the subassemblies to the cable.

In the presently preferred embodiment, the first and second captivation means comprise first and second split retention rings on the center contact and inner shell subassemblies, respectively, and surfaces on the inner shell and outer shell subassemblies, respectively, that are engaged by the first and second split retention rings to maintain the subassemblies axially aligned during attachment of the subassemblies to the cable. Accordingly, when the connector has been fully assembled and attached to the cable, proper axial alignment of the subassemblies and of the electrical contacts therein is assured.

A connector of the invention also includes first and second ferrules for crimping the first outer conductor against the inner shell and for crimping the second outer conductor against the outer shell. The second ferrule, in particular, is positioned within the outer shell during the crimping operation, and positioning means are provided on the second ferrule for ensuring that it is properly positioned within the outer shell during crimping. The positioning means comprises a plurality of dimples on the ferrule for biting into a dielectric layer of the cable to prevent movement of the second ferrule out of position during the assembly process.

Thus, the present invention provides a connector which can be assembled and attached to a cable quickly and accurately. The connector includes built-in structures to achieve and retain proper positioning of the connector components during assembly and during attachment to the cable to ensure reliable operation of the connector.

Further advantages and more specific details of the invention will be set forth hereinafter in conjunction with the detailed description of a presently preferred embodiment.

DETAILED DESCRIPTION OF THE PREFERRED EMBODIMENT

Figures 1, 2A, 2B, 2C, 2D:
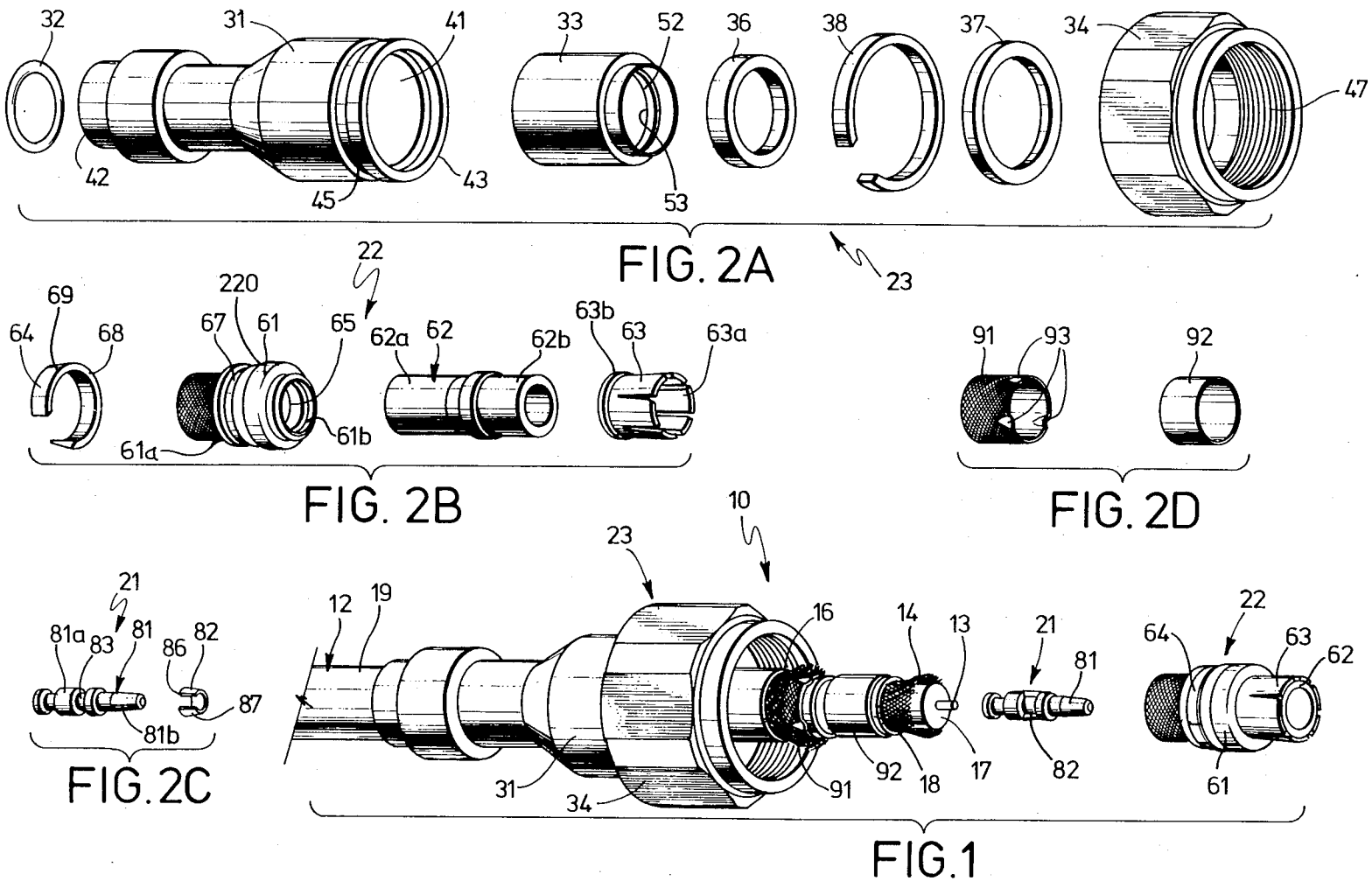
FIG. 1 is a partially exploded view of an electrical plug connector according to a presently preferred embodiment of the invention.
FIG. 2A is an exploded view of the outer shell subassembly of FIG. 1.
FIG. 2B is an exploded view of the inner shell subassembly of FIG. 1.
FIG. 2C is an exploded view of the center contact subassembly of FIG. 1.
FIG. 2D illustrates the ferrules in the connector of FIG. 1.
Figure 3:
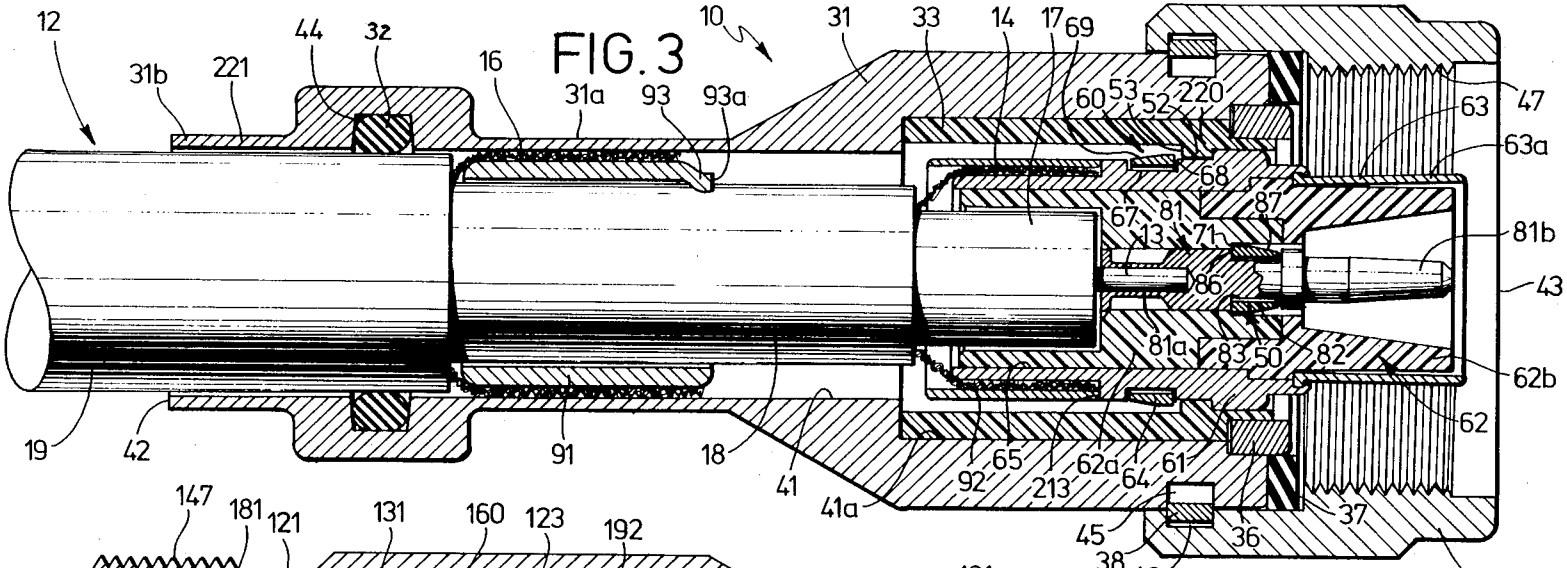
FIG. 3 is a cross-sectional view of the connector of FIG. 1 in assembled form.

FIGS. 1–3 illustrate a presently preferred embodiment of an electrical connector of the invention. FIG. 1 is a partially exploded view illustrating the separate subassemblies of the connector. FIGS. 2A–2C are exploded views of the outer shell, inner shell and center contact subassemblies, respectively; and FIG. 2D illustrates the inner and intermediate ferrules of the connector. FIG. 3 is a cross-sectional view of the connector of FIG. 1 in assembled form.

The connector of FIGS. 1–3 is generally designated by reference numeral 10, and comprises a triaxial plug connector for terminating a triaxial cable 12. As best shown in FIGS. 1 and 3, triaxial cable 12 includes a center conductor 13, an intermediate conductor 14, and an outer conductor 16. As is known to those skilled in the art, center conductor 13 typically comprises an electrically conductive wire, and the intermediate and outer conductors 14 and 16 comprise annular braided conductors positioned concentrically around inner conductor 13 to provide shielding for the central conductor. The conductors are electrically isolated from one another by insulating layers 17 and 18, and the outer conductor is covered by a jacket 19.

As shown in FIG. 1, plug connector 10 includes a center contact subassembly 21 adapted to be electrically connected to center conductor 13 of cable 12, an inner shell subassembly 22 adapted to be electrically connected to intermediate conductor 14, and an outer shell subassembly 23 adapted to be electrically connected to outer conductor 16. Each of the subassemblies 21, 22 and 23 is manufactured as a complete, fully assembled unit, and the subassemblies are assembled together as units to complete connector 10 as the connector is attached to cable 12. The outer shell subassembly is illustrated in FIG. 2A; the inner shell subassembly is illustrated in FIG. 2B; and the center contact subassembly is illustrated in FIG. 2C.

Outer shell subassembly 23, as illustrated in exploded view in FIG. 2A, comprises an electrically conductive outer shell 31, a resilient O-ring 32, an insulating member 33, a collar 34, a conductive bushing 36, a gasket 37, and a washer 38. Outer shell 31 is of generally tubular shape and has an axial passageway 41 extending therethrough from rear end 42 to front end 43 thereof. Outer shell 31 is adapted to permit cable 12 to be received within end 42 of passageway 41 as shown in FIGS. 1 and 3. Outer shell 31 can be constructed of any electrically conductive material, such as copper or brass, that will provide sufficient structural rigidity to the connector as is known to those skilled in the art.

Resilient O-ring 32 is positioned within an internal annular groove 44 in shell 31 (see FIG. 3) to seal between the shell 31 and the outer jacket 19 of cable 12 when the shell 31 is mounted to the end of the cable. Collar 34, which can be constructed of brass, is rotatably mounted to outer shell 31 by washer 38 which is positioned within aligned grooves 45 and 46 (see FIG. 3) in the shell and collar, respectively. A portion of the inner surface of collar 34 is threaded as shown at 47 to connect plug connector 10 to a matable jack connector as will be explained hereinafter.

Insulating member 33 is positioned in shell 31 within an enlarged diameter portion **41*a* of passageway 41. Insulating member 33 comprises a tubular-shaped member of suitable dielectric material such as polyvinylidene fluoride, and electrically insulates electrically conductive outer shell 31 from electrically conductive inner shell 61 of the inner shell subassembly 22. Insulating member 33 is formed to define an inwardly extending annular projection or rib 52 and a rearwardly facing annular shoulder 53 (see FIG. 3), which is adapted to cooperate with a resilient portion (e.g., split retention ring 64) on the inner shell subassembly 22 to comprise second captivation means 60** for securing the inner and outer shell subassemblies together during assembly of the connector.

Figure 5:
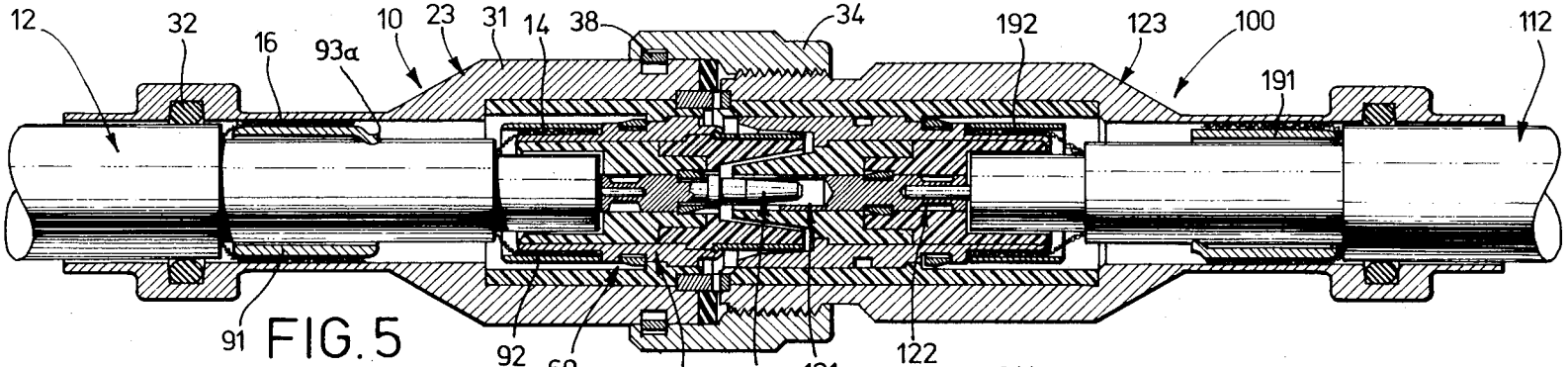
FIG. 5 is a cross-sectional view of the plug and jack connectors of FIGS. 3 and 4 when mated.

Bushing 36, which can be formed of brass or another suitable electrically conductive material, is mounted within the front edge of insulating member 33 and is in electrical contact with outer shell 31 to function as an outer contact of the connector. Gasket 37 is positioned within the subassembly to seal between the plug connector 12 and a complementary jack connector when the connectors are mated as shown in FIG. 5. Gasket 37 can be formed of a silicone rubber or another suitable sealing material.

The components 31, 32, 33, 34, 36, 37 and 38, comprising the outer shell subassembly 23, are assembled together as a complete, fully assembled unit as shown in FIG. 1, to be later assembled to the inner shell and center contact subassemblies when connector 10 is attached to cable 12.

Inner shell subassembly 22, as illustrated in exploded view in FIG. 2B, comprises an electrically conductive inner shell 61, an insulating member 62, an intermediate contact 63, and a resilient portion or split retention ring 64. Inner shell 61 is adapted to be electrically coupled to intermediate braided conductor 14 of cable 12, and comprises a generally tubularshaped, electrically conductive member having an axial passageway 65 extending therethrough. Insulating member 62, formed, for example, of polyvinylidene fluoride, electrically insulates the inner shell 61 from the center contact 81 of center contact subassembly 21. Insulating member 62 comprises an internal undercut defining a forwardly facing annular shoulder 71 (see FIG. 3), which is adapted to cooperate with a resilient portion (e.g., split retention ring 82) on the center contact subassembly 21 to comprise first captivation means 50 for securing the inner sleeve subassembly and the center contact subassembly together during assembly of the connector. Insulating member 62 is preferably formed in two parts **62*a* and 62*b*, as shown in FIG. 3, to more easily form the undercut for defining shoulder 71**.

Inner shell subassembly 22 further includes a resilient split retention ring 64 which is positioned within an annular groove 67 in the outer surface of inner shell 61. As best shown in FIG. 3, retention ring 64 has a front face 68 and an outer surface 69 which tapers downwardly from front face 68 to the back of the ring. Retention ring 64 cooperates with shoulder 53 on insulating member 33 of outer shell subassembly 23 to capture and secure the inner and outer shell subassemblies to one another and to maintain the two subassemblies in proper alignment during assembly of the connector.

Intermediate contact 63 is secured to inner shell 61 by engagement of annular projection 63*b* and the annular groove 61*b* of shell 61. For example, the end edge of the shell 61 is radially inwardly swaged over the edge of projection 63b in the groove 61*b*. Contact 63 comprises a plurality of spring fingers 63*a* which extend outwardly from the inner shell 61. Intermediate contact 63 is adapted to be electrically coupled to intermediate conductor 14 of cable 12 via inner shell 61.

As illustrated in FIG. 2C, center contact subassembly 21 includes a center contact 81 and a resilient portion or split retention ring 82. As is known to those skilled in the art, center contact 81 comprises a socket portion 81*a* for receiving the exposed end of center conductor 13 of cable 12, and a pin portion 18*b* to mate with a socket center contact on a complementary jack connector. Retention ring 82 is supported within an annular groove 83 around center contact 81, and has a rear face 86 and a tapered outer surface 87. Retention ring 82 is adapted to cooperate with shoulder 71 on insulating member 62 of inner shell subassembly 22 (see FIG. 3) to secure the center contact subassembly and the inner shell subassembly to one another and to maintain the two subassemblies in proper axial alignment during assembly of the connector 10.

Connector 10 also includes a pair of ferrules 91 and 92 shown in FIG. 2D. As shown in FIG. 3, ferrule 91 cooperates with the outer shell 31 to crimp the outer conductor 16 between the ferrule 91 and the inner surface of outer shell 31. Ferrule 92 cooperates with inner shell 61 to crimp the intermediate conductor 14 between the ferrule 92 and the knurled outer surface 61*a* of inner shell 61. Ferrule 91 is formed to have a plurality of dimples 93; e.g., three dimples, around the front edge thereof. Dimples 93 are shaped to define sharp edges 93*a* which permit the ferrule 91 to be slid onto the intermediate insulating layer 18 of cable 12 and resist the withdrawal therefrom as will be explained hereinafter.

Figure 4:
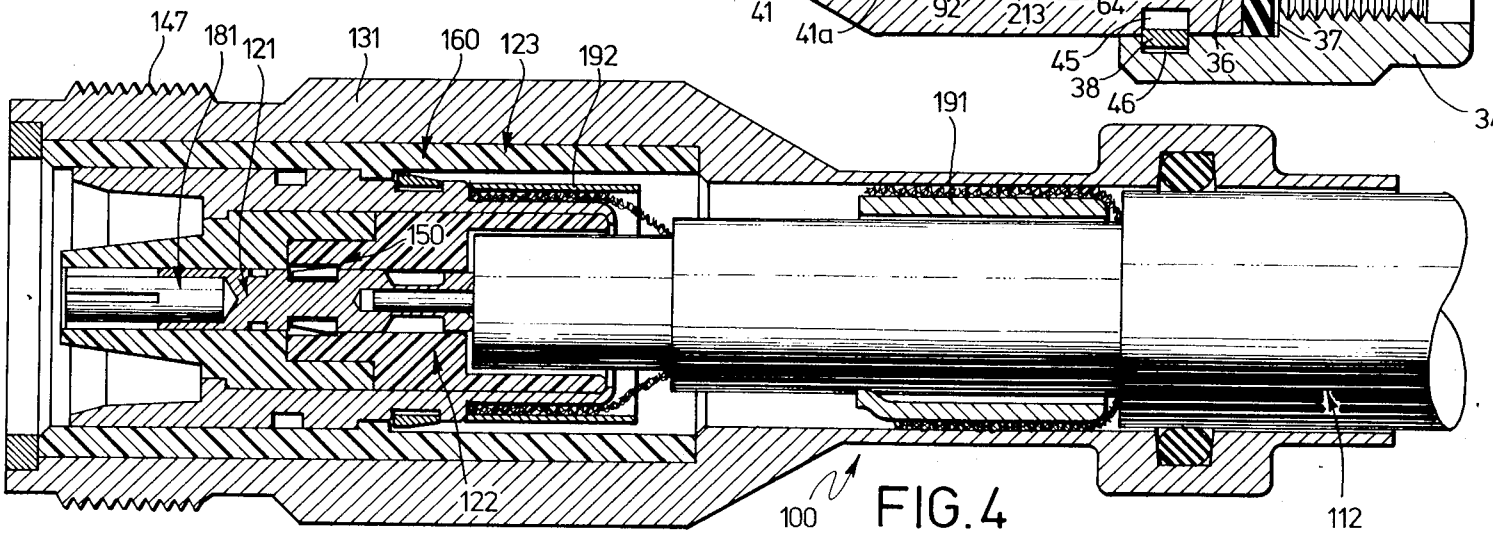
FIG. 4 is a cross-sectional view of a jack connector according to a presently preferred embodiment of the invention.

FIG. 4 illustrates a jack connector 100, according to a presently preferred embodiment of the invention, attached to the end of a cable 112. Jack connector 100 is matable with the plug connector 10 of FIGS. 1–3. Jack connector 100 is similar in construction to plug connector 10, differing primarily in the shape of the several components that interconnect to permit mating of the jack and plug connectors as illustrated in FIG. 5. For example, jack connector 100 includes a center contact 181 which is configured to receive center pin contact portion 81*b* of plug connector 10. In addition, outer shell 131 of jack connector 100 is externally threaded as shown at 147 to engage internally threaded surface 47 on collar 34 when the two connectors are mated. In all respects pertinent to the present invention, however, jack connector 100 is similar to plug connector 10 and includes a center contact subassembly 121, an inner shell subassembly 122, an outer shell subassembly 123, first captivation means 150, second captivation means 160, and inner and intermediate ferrules 191 and 192, respectively. The description of the invention herein, therefore, applies equally to plug connector 10 and to jack connector 100, and accordingly, a detailed description of the jack connector is unnecessary.

FIG. 5 illustrates the plug and jack connectors 10 and 100, respectively, mated to one another to connect electric circuits through the connectors as is known to those skilled in the art.

FIGS. 6–9 schematically illustrate the procedure for assembling plug connector 10 and for simultaneously mounting the connector to a triaxial cable 12. Jack connector 100 is assembled to cable 112 in a similar manner and need not be separately described. Each of the plurality of subassemblies includes one or more surfaces that interfit with the surface of one or more of the other subassemblies so that the subassemblies may be assembled together by movement axially along the cable.

Figure 6:
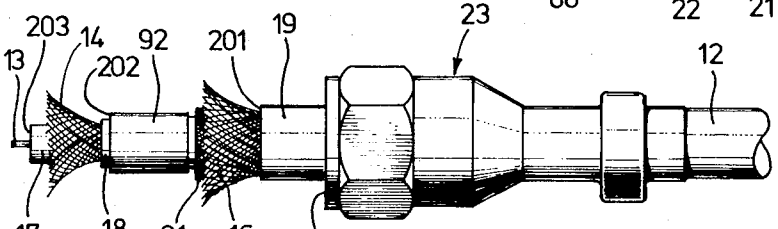

With reference to FIG. 6, the outer shell subassembly 23 is slid and rotated onto cable 12 such that the front end 43 of the outer shell faces the end of the cable to be terminated. A portion of the outer jacket 19 of cable 12 is removed at 201 to expose the outer braided conductor 16. The exposed outer conductor 16 is then flared outwardly as shown in FIG. 6 to the base of the outer jacket at 201 to expose the intermediate insulation layer 18 thereunder. The second ferrule 91 and the first ferrule 92 are then slid over the exposed intermediate insulation 18 and beneath the flared outer conductor as shown. As will be explained hereinafter, the second ferrule 91, in particular, is slid onto the cable as far as it will go until it butts against the edge of the outer jacket 19 adjacent edge 201 which prevents further movement of the ferrule onto the cable. The second ferrule 91 is thereafter prevented from being removed from the cable by the dimples 93 thereon engaging the insulation layer 18. As best shown in FIG. 3, the dimples 93 permit the ferrule 91 to be slid onto the cable, but the sharp end edges 93*a* thereon bite into the intermediate insulation layer 18 to resist removal of the ferrule. Thus, second ferrule 91 is essentially locked in position on the cable by the edge of outer jacket 19, which limits movement onto the cable, and by dimples 93, which prevent removal of the ferrule from the cable. First ferrule 92 is sized to loosely encircle and slide onto the cable as shown in FIG. 6.

Following assembly of the ferrules onto the cable, the intermediate insulation 18 is then stripped away at 202 to expose the intermediate braided conductor 14. Conductor 14 is also flared outwardly as shown in FIG. 6 to expose the inner insulation layer 17. The inner insulation layer 17 is then stripped to an end at 203 to expose a portion of the center conductor 13.

Thus, following the steps illustrated in FIG. 6, the outer shell subassembly 23 is loosely positioned on the outer jacket of cable 12. Each of the conductors in the cable has been exposed, and the two ferrules 91 and 92 have been slid onto the intermediate insulation layer 18 of the cable. Second ferrule 91 is fixed in position on insulation layer 18, and first ferrule 92 is loosely positioned on the insulation layer 18.

Figure 7:
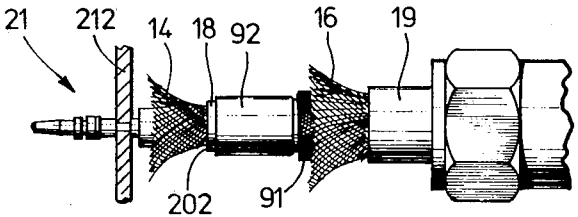

The next step in the assembly procedure is to attach center contact subassembly 21 to center conductor 13 as illustrated in FIG. 7. Specifically, in FIG. 7, the center conductor 13 is inserted into conductor-receiving portion 81a of center contact 81, and the center contact is crimped to the conductor using an appropriate crimping die schematically illustrated at 212.

Figure 8:
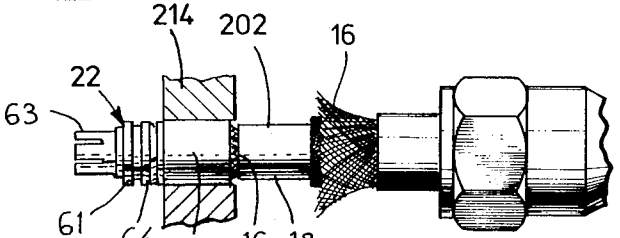
FIGS. 6–9 illustrate the procedure for assembling the connector of FIG. 1 to the end of a triaxial cable.

With reference now to FIG. 8, the attached center contact subassembly 21 is then inserted into the rear of the inner shell subassembly 22 until inner shell subassembly 22 bottoms out against the end 203 of inner insulating layer 17. The inner shell subassembly 22 is positioned beneath flared intermediate conductor 14. During insertion of the center contact subassembly into the inner shell subassembly, the inner surface of insulating member 62 on the inner shell subassembly will compress against the tapered surface of resilient split retention ring 82 and annularly contracts the ring 82 while on center contact assembly 21 to permit insertion to proceed. When, however, the retention ring 82 clears shoulder 71 on the insulating member 62, retention ring 82 will expand outwardly to engage shoulder 71, thereby forming captivation means 50 to thereafter prevent withdrawal of the center contact subassembly rearwardly from the inner shell subassembly and to secure the center contact and inner shell subassemblies to one another in proper axial alignment. The center contact subassembly and the inner shell subassembly are thus locked in correct alignment with respect to one another by the edge 203 of inner insulation layer 17 and by the first captivation means 50. When the subassemblies are locked in position, the first ferrule 92 is slid forwardly (FIG. 8) over the flared intermediate conductor 14 until ferrule 92 impinges on rearwardly facing shoulder 213 of the inner shell 61 (see FIG. 3). In this position, ferrule 92 is positioned with braided intermediate conductor 14 positioned between the outer surface of inner shell 61 and the inner surface of ferrule 92. The ferrule is then crimped to the inner shell to secure the intermediate conductor therebetween using a crimping tool schematically shown at 214 in FIG. 8. The width of the tool 214 exceeds the axial length of the ferrule 92 showing a portion of the braid 14.

Figure 9:
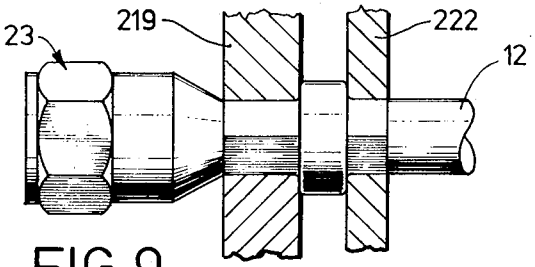

The outer shell subassembly 23 is then slid forwardly over the inner shell subassembly 22. As the outer shell subassembly is slid over the inner shell subassembly, resilient split retention ring 64 on the inner shell subassembly will be annularly inwardly contracted by the inner surface of rib 52 the outer shell subassembly engaging the tapered surface of the ring 64, until the retention ring 64 clears shoulder 53 on dielectric member 33. The retention ring 64 will then expand outwardly to engage axially the shoulder 53, thereby forming a second captivation means 60 to thereafter prevent rearward movement of the outer shell subassembly 23 with respect to the inner shell subassembly 22. Further forward movement of the outer shell subassembly is prevented by outwardly extending shoulder 220 on inner shell 61. Thus, the inner and outer shell subassemblies are locked in correct axial alignment with respect to one another by shoulder 220 on inner shell 61 and by second captivation means 60. In this position, second ferrule 91 will automatically be properly positioned beneath portion 31*a* (see FIG. 3) of the outer shell 31 to permit crimping the outer conductor 16 therebetween with a crimping tool 219 as shown in FIG. 9.

The outer shell 31 is also crimped against the outer jacket 19 of the cable at shell portion 31*b* (see FIG. 3) by a crimping tool 222 to provide strain relief. Thus, upon assembly, the plural captivation means 50 and 60 maintain the connector elements in axial alignment and, in conjunction with the plural ferrule means, provide reliable electrical connections to conductors of the cable.

While what has been described constitutes a presently preferred embodiment of the invention, it should be understood that the invention could take various other forms. For example, although a triaxial connector has been described herein, the invention could also be practiced with a coaxial connector. Also, the first and second retention means 50 and 60 could take other forms. Because the invention can take many forms, it should be understood that the invention should be limited only insofar as is required by the scope of the following claims.

I claim:

1. In an electrical connector assembly for connection to an electrical cable, wherein the improvement comprises;

a first ferrule for insertion concentrically between a conductive outer shield of the cable and a first insulative layer of the cable, a center contact subassembly comprising, a first retention ring assembled over a center contact and having a forward taper and a rear facing shoulder, the center contact subassembly is assembled as a unit and is constructed for assembly as said unit to a center conductor of the cable by connection of the center contact to the center conductor, an inner shell subassembly comprising, a conductive inner shell, a second retention ring assembled over the inner shell and having a rearward taper and a forward facing shoulder, and an insulating means extending within a rearward end of the inner shell for insulating the center contact assembly from the inner shell, the insulating means having an internal forward facing shoulder, the inner shell subassembly is assembled as a unit and is constructed for assembly as said unit over the center contact subassembly and between a second insulative layer of the cable and a conductive inner shield of the cable by passage of the insulating means in a rearward direction over the center contact assembly until the forward facing shoulder of the insulating means passes in a rearward direction over the taper of the second retention ring and registers at the rear of the forward facing shoulder of the second retention ring, and by passage of the rearward end of the inner shell and the insulating means concentrically between the second insulating layer of the cable and the inner shield of the cable, a conductive second ferrule for assembly concentrically over the inner shield of the cable and the rearward end of the inner shell, an outer shell subassembly, comprising, a conductive outer shell, coupling means on the outer shell for coupling the outer shell to a complementary electrical connector, an O-ring within a rearward end of the outer shell to seal between the outer shell and an outer jacket of the cable, an insulating member extending within a forward end of the outer shell for insulating the outer shell from the inner shell, the insulating member having a rearward facing shoulder, the outer shell subassembly is constructed for assembly as a unit, and is constructed for assembly as said unit over the inner shell subassembly by passage of the insulating member in a forward direction over the first ferrule and the second ferrule and over the inner shell until the rearward facing shoulder passes over the rearward taper of the second retention ring and registers against the forward facing shoulder of the second retention ring, and until the outer shell is concentric with the outer shield of the cable and the first ferrule.

2. A connector as recited in claim 1, wherein the improvement further comprises; the first retention ring is assembled in a groove of the center contact, and the second retention ring is assembled in a groove of the inner shell.

* * * * *